US006364790B1

(12) United States Patent
Carrie et al.

(10) Patent No.: US 6,364,790 B1
(45) Date of Patent: Apr. 2, 2002

(54) PORTABLE HOCKEY PRACTICE APPARATUS

(76) Inventors: David Carrie, 2162 Portage Rd., Niagara Falls, Ont (CA), L6H 3L1; Steven Murdza, Box 209, St. David's, Ont (CA), L0S 1P0

( * ) Notice: Subject to any disclaimer, the term of this patent is extended or adjusted under 35 U.S.C. 154(b) by 0 days.

(21) Appl. No.: 09/315,154

(22) Filed: May 20, 1999

(51) Int. Cl.[7] ..... A63B 69/00
(52) U.S. Cl. ..... 473/422; 473/278
(58) Field of Search ..... 473/415, 442, 473/446, 478, 157, 158, 159, 164; 472/92

(56) References Cited

U.S. PATENT DOCUMENTS 3,955,815 A * 5/1976 Deschesnes
4,030,729 A * 6/1977 Nathaniel ..... 472/90
4,834,502 A * 5/1989 Bristol et al. ..... 366/279
4,886,274 A * 12/1989 Park ..... 473/164
5,249,797 A * 10/1993 Dowhy
5,816,945 A * 10/1998 Todd et al.
5,942,311 A * 8/1999 Scianna ..... 428/195
6,004,219 A * 12/1999 Peabody ..... 473/157

* cited by examiner

*Primary Examiner*—Paul T. Sewell
*Assistant Examiner*—M. Chambers
(74) *Attorney, Agent, or Firm*—Wallace F. Neyerlin

(57) ABSTRACT

A hockey practice apparatus comprises a thin mat member having a length and a width each substantially greater than its thickness, a generally centrally disposed longitudinal axis extending along its length, and including a bottom stratum presenting a slippage precluding bottom surface and a top stratum adjoined to the bottom stratum and presenting a low friction substantially planar top surface for receiving a hockey puck in free sliding relation thereon. A method of teaching hockey skills comprising the steps of providing a practice surface for receiving a hockey puck thereon; initially placing a visual target adjacent the practice surface so as to be viewable concurrently with the practice surface by a practising player standing beside the practice surface and stickhandling the puck with a hockey stick, thereby encouraging the practising player to look at the visual target while stickhandling the puck with a hockey stick; and, subsequently moving the visual target to a superior position in the practising player's field of view, thereby encouraging the practising player to look up while stickhandling the puck with a hockey stick.

20 Claims, 6 Drawing Sheets

PORTABLE HOCKEY PRACTICE APPARATUS

FIELD OF THE INVENTION

The present invention relates to apparatus for teaching and practising hockey and methods of teaching and practising hockey skills.

1. Background of the Invention

Hockey is a game involving a variety of highly developed skills, including skating, shooting, passing, and also one of the hardest skills to master, namely stickhandling. Proper stickhandling requires the skillful manipulation of a puck while keeping one's head up, often during high speed skating maneuvers. Accordingly, learning and subsequently remembering to keep one's head up while stickhandling is very difficult. Moreover, a person's dependence on vision for tasks and skill development further reinforces the natural tendency in hockey to look at the puck while stickhandling.

One reason stickhandling with one's head up is so difficult to learn and subsequently master, is that a constant reminder is required during stickhandling practice to keep one's head up and not look at the puck. It is very difficult to Provide the necessary instruction and visual target while a player is stickhandling on an ice rink.

Moreover, in order to learn the art of stickhandling, it is necessary to practice for many hours on an ongoing basis. Typically, there is very little ice time during a hockey game or hockey practice for each player to be taught and practice stickhandling, thus, stickhandling with one's head up is generally not well learned.

Typically, during a hockey game, each player is on the ice only for about one third of the game and on average would handle the puck one tenth of the time since there are five players per team and two teams. This translates to about two minutes of handling of the puck, on average, during a game, and onlyl part of this two minutes is spent stickhandling. Moreover, the players who have the best stickhandling skills usually have the puck much more than other players of lesser stickhandling ability. Accordingly, the players of lesser stickhandling ability, who need more practice, actually have the puck for very little time during a game.

Also, during a hockey practice on a hockey rink, the most valuable use of time is to practice plays and other drills that cannot be practiced off-ice. Accordingly, during a hockey practice, a very limited amount of stickhandling is taught and practiced. Moreover, drills that can be practiced off ice, are usually practiced without the assistance of a coach, and therefore are usually not practiced properly, thus resulting in proper techniques not being learned.

2. Prior Art

Various prior art devices exist that attempt to provide means to learn and practice stickhandling. None of these prior art devices teaches the necessary skills properly, and neither provides proper means for teaching a hockey player to keep one's head up.

U.S. Pat. No. 5,816,945, issued to Todd et al, discloses a hockey training device secured by a swivel attachment at one end to a hockey stick near the bottom end of the shaft and secured at its opposite end to a puck. Essentially, this hockey training device merely tethers the puck to the hockey stick, thus precluding the puck from traveling out of reach during stickhandling practice. It is believed that tethering a hockey puck to a hockey stick teaches an unnatural stickhandling effort, which is very undesirable. Further, it provides no specific means for teaching heads-up stickhandling.

U.S. Pat. No. 3,955,815, issued to Deschesnes, discloses a hockey training device having a simulated puck, adapted to be propelled by a hockey stick over a playing surface. The puck is connected, through a slot, to a movable carriage beneath the playing surface. The carriage is connected to the resilient member, the force of which can be adjusted. The force of the resilient member must be overcome in propelling the puck, thus strengthening the player's shot. The resilient member returns the puck to a start position after each practice shot. This hockey training device is for improving a player's shot strength only.

U.S. Pat. No. 5,249,797, issued to Dowhy, discloses a hockey training aid and game apparatus, including a portable housing having a base unit and a cover connected to the base unit. A first sensor assembly is recessed in the center of the floor and is used for monitoring accurate puck handling. A second sensor assembly comprising ribbon sensors located in spaced relation generally surrounding the first sensor assembly monitor inaccurate puck handling. Each time the puck, which has a permanent magnet inside, passes over the first sensor assembly, a first counter is tallied. Similarly, each time the puck passes over the second sensor assembly, a second counter is tallied. A player's score is determined by subtracting the second score from the first score. It can be seen that in order to help maximize a player's score, it is necessary to pass the puck over the first sensor assembly as quickly as possible, thus encouraging a player to stickhandle in an unrealistic manner within an extremely confined central area. Reinforcement of this is realized by the subtractive penalty incurred for moving the puck over the second sensor assembly, and thus outside this extremely confined central area. This manner of stickhandling is not representative whatsoever of proper stickhandling that would be used during a hockey game. Further, it encourages a player to look downwardly so as to be able to see the first and second sensor assemblies, instead of teaching a player to look up while stickhandling.

It is an object of the present invention to provide a means to teach a hockey player to keep his head up while stickhandling.

It is another object of the present invention to provide a means to permit a hockey player to practice the art of stickhandling while keeping his head up.

It is a further object of the present invention to provide a means to permit a hockey player to learn and practice realistic stickhandling skills.

It is a further object of the present invention to provide a means to permit a hockey player to learn and practice useful stickhandling patterns.

3. Summary of the Invention

In accordance with one aspect of the present invention, there is disclosed a novel hockey practice apparatus comprising a thin mat member having a length and a width each substantially greater than its thickness, a generally centrally disposed longitudinal axis extending along its length, and including a bottom stratum presenting a slippage precluding bottom surface and a top stratum adjoined to the bottom stratum and presenting a low friction substantially planar top surface for receiving a hockey puck in free sliding relation thereon.

In accordance with one aspect of the present invention, there is disclosed a novel method of teaching hockey skills comprising the steps of:

(a) providing a practice surface for receiving a hockey puck thereon;

(b) initially placing a visual target adjacent the practice surface so as to be viewable concurrently with the practice surface by a practising player standing beside the practice surface and stickhandling the puck with a hockey stick, thereby encouraging the practising player to look at the visual target while stickhandling the puck with a hockey stick; and, (c) subsequently moving the visual target to a superior position in the practising player's field of view, thereby encouraging the practising player to look up while stickhandling the puck with a hockey stick.

Other advantages, features and characteristics of the present invention, as well as functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the hockey practice apparatus according to the present invention, as to its structure and use, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
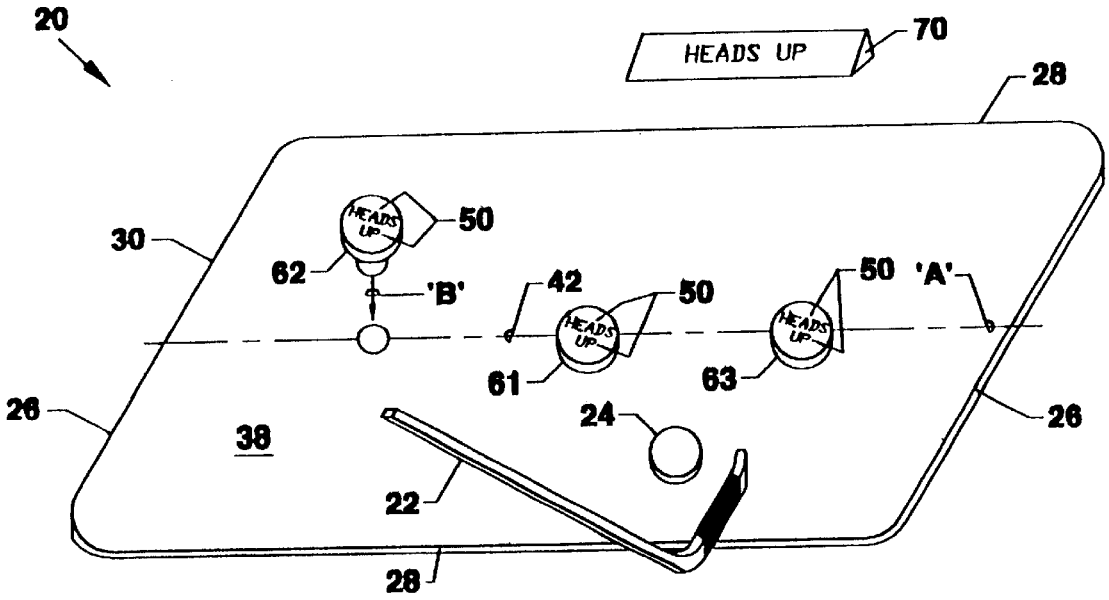
FIG. 1 is a perspective view of the preferred embodiment of the hockey practice apparatus according to the present invention, with first and second obstacles in place and a third obstacle being put in place, and also showing a hockey stick being used by a player (shown partially) to stickhandle a hockey puck.
Figure 2:
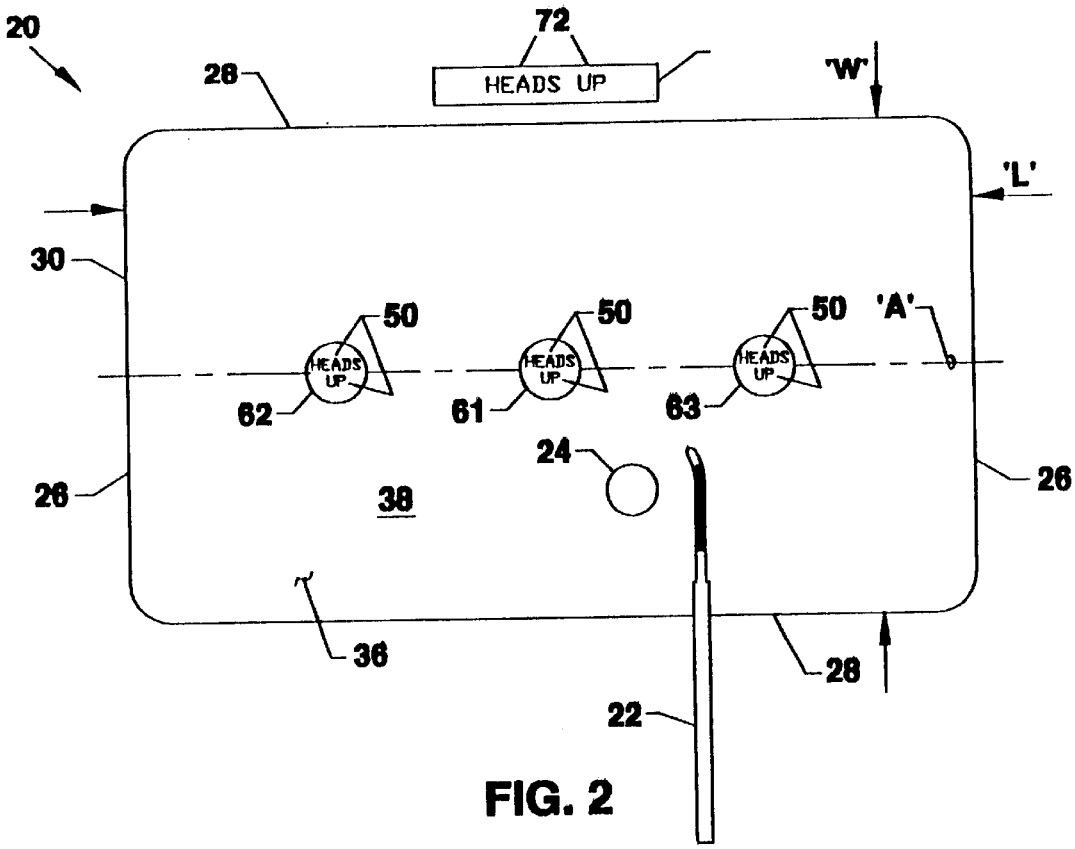
FIG. 2 is a top plan view of the preferred embodiment hockey practice apparatus of FIG. 1.
Figure 3:
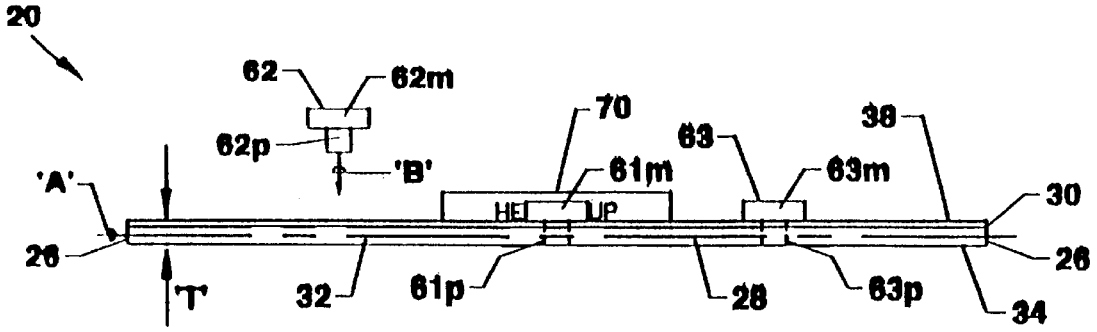
FIG. 3 is a side elevational view of the preferred embodiment hockey practice apparatus of FIG. 1.

Reference will now be made to FIGS. 1 through 6C of the drawings, which show the preferred embodiment of the hockey practice apparatus of the present invention, as indicated by the general reference numeral 20. The hockey practice apparatus 20 comprises a thin mat member 30 having a substantially constant thickness "T" defined between a bottom surface 34 and a top surface 38, a length "L" defined between a opposite end edges 26, and a width "W" defined between a opposite side edges 28. Each of the length "L" and the width "W" are substantially greater than its thickness "T". It has been found that a length "L" of about six feet and width "W" of about four feet is suitable. A generally centrally disposed longitudinal axis "A" extends along its length "L".

The hockey practice apparatus 20 includes a bottom stratum 32 presenting the slippage precluding bottom surface 34. Preferably, the bottom stratum 32 is less than about ⅜" thick and ideally is between about ¼ inch to about ⅜" thick, and is resiliently deformable to absorb the impact of a hockey stick and so as to permit bending or rolling of the hockey practice apparatus 20. The bottom stratum 32 is made from polymer foam material, which has been found to work well during testing. Other suitable materials may also be used to form the bottom stratum.

A top stratum 36 presents the low friction substantially planar top surface 38 for receiving a hockey puck 24 in free sliding relation thereon. Preferably, the top stratum 36 is made from polycarbonate resin material (sold by General Electric company under the trademark LEXAN) and is adjoined to the bottom stratum 32 by means of a suitable adhesive. It has been found that a top stratum 36 having a thickness of less than about 1/16" works well, so as to permit bending or rolling of the hockey practice apparatus 20.

The hockey practice apparatus 20 has at least one designated obstacle receiving position, and in the preferred embodiment as illustrated, has a plurality of designated obstacle receiving positions, specifically three designated obstacle receiving positions. The three designated obstacle receiving positions are predetermined positions for placing obstacles to stickhandling a puck 24, namely a first obstacle 61 a second obstacle 62, and a third obstacle 63, as will be discussed in greater detail subsequently. In the preferred embodiment, there is a plurality of orifices, specifically three orifices, in the thin mat member 30, namely a first orifice 41, a second orifice 42, and a third orifice 43. Each of the first, 41, second 42, and third 43 orifices is disposed at a corresponding one of the designated obstacle receiving positions. The three orifices 41, 42, and 43 are aligned along the generally centrally disposed longitudinal axis "A" so as to provide the same amount of room for stickhandling between the first 61, second 62, and third 63 obstacles, and each of the side edges 28. Also, the three orifices 41, 42 and 43 are the same shape and size and extend completely through the thin mat member 30, for ease of manufacturing purposes.

The first obstacle 61, the second obstacle 62, and the third obstacle 63, are each situateable adjacent the thin mat member 30, so as to each extend upwardly from the top surface 38 of the thin mat member 30, thereby providing first, second, and third circumventable obstructions, respectively, to the passage of the hockey stick 22 and puck 24 along the top surface 38 of the thin mat member 30. In the preferred embodiment, as illustrated, the first 61, second 62 and third 63 obstacles are each selectively situateable on and removable from the thin mat member 30, as will be described in greater detail subsequently. As can be best seen in FIGS. 1 and 3, the second obstacle 62 is about to be placed into the second orifice 42, as indicated by arrow "B".

Figure 4:
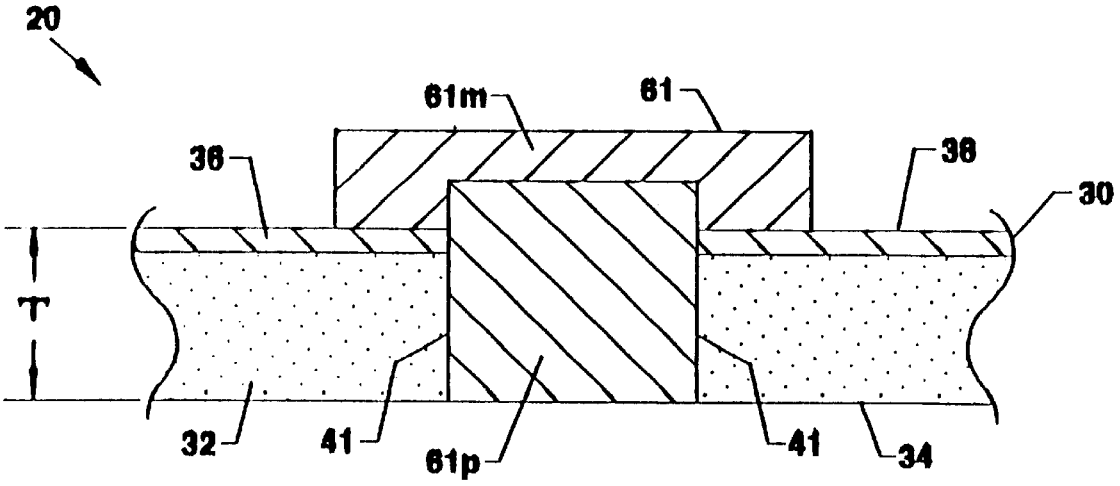
FIG. 4 is an enlarged cross-sectional side elevational view of a portion of the hockey practice apparatus, taken along section line 4—4 of FIG. 2.

As is best seen in FIG. 4, each of the first obstacle 61, the second obstacle 62, and the third obstacle 63 has a main body portion (61*m*, 62*m*, 63*m*, respectively) and a post portion (61*p*, 62*p*, 63*p*, respectively) having a smaller diameter than the respective main body portion 61*m*, 62*m*, 63*m*. In the preferred embodiment as illustrated, the post portions 61*p*, 62*p*, 63*p* are securely frictionally fit into the respective main body portions 61*m*, 62*m*, 63*m*. Alternatively, the first obstacle 61, the second obstacle 62, and the third obstacle 63 may be molded from a single piece of material. Preferably the first 61, second 62, and third 63 obstacles are each same size so as to provide the same circumventable obstruction at each of the three designated obstacle receiving positions.

Instructional indicia 50, specifically the phrase "HEADS UP", are disposed on the first 61, second 62, and third 63 obstacles. It should be noted that the puck 24 being used for stickhandling does not have the same indicia thereon as do the first, second, and third obstacles, but has noticeably different indicia or a noticeably different logo, or no markings at all, so as to permit the player 25 practising stickhandling to readily distinguish between the puck 24 and the first 61, the second 62, and third 63 obstacles. Preferably, the first 61, the second 62 and third 63 obstacles are interchangeable one with another in the first 41, second 42, and third 43 orifices, and for ease of manufacturing purposes are preferably identical one to the other.

Each of the first 41, second 42, and third 43 orifices is disposed at a corresponding designated obstacle receiving position, to receive a portion of the first obstacle 61 therein. Specifically, the post portions 61*p*, 62*p*, 63*p* of each of the first 61, second 62, and third 63 obstacles are received in frictional fit relation in a corresponding one of the first 41, second 42, and third 43 orifices. In this manner, the first 61, second 62, and third 63 obstacles are each received and retained in place so as to not be inadvertently removed from their set positions in the respective one of the first 41, second 42, and third 43 orifices, by impact of the hockey stick 22 being stickhandled or by the puck 24 being used.

Alternatively, any or all of the first 61, the second 62, and the third 63 obstacles may be permanently affixed to the hockey practice apparatus 20, if desired, in order to reduce manufacturing costs and to preclude the first 61, the second 62, and the third 63 obstacles from becoming lost.

A visual target 70 having instructional indicia 72 thereon is also provided. Similarly to the first 61, second 62, and third 63 obstacles, the instructional indicia form the phrase "HEADS UP", so as to remind a player 25 practising stickhandling with the present invention to keep his head up. The visual target 70 is for placement in a series of positions adjacent the hockey practice apparatus 20, as can be best seen in FIGS. 6A through 6C.

Figure 6A:
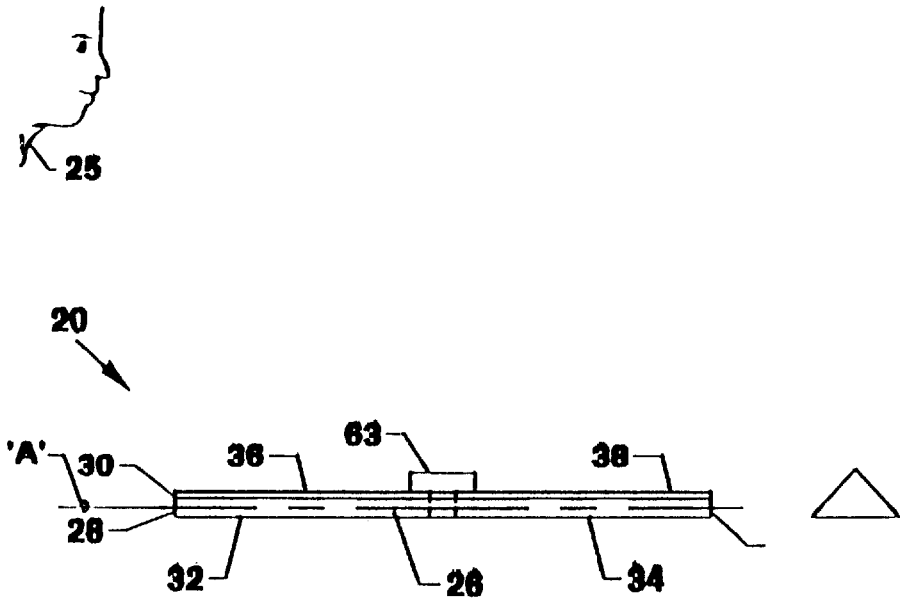
FIG. 6A is an end elevational view of the preferred embodiment hockey practice apparatus of FIG. 1, and a visual target having instructional indicia thereon placed adjacent to the hockey practice apparatus.
Figure 6B:
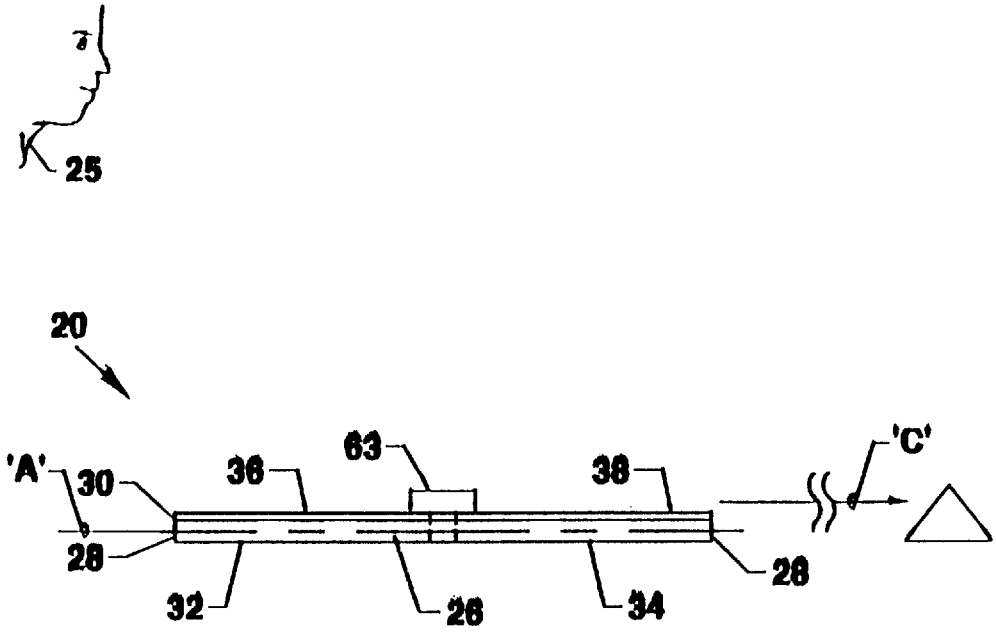
FIG. 6B is an end elevational view similar to FIG. 6A, with the visual target placed farther away from the hockey practice apparatus; and, FIG. 6C is an end elevational view similar to FIG. 6B, with the visual target placed at the eye level of a practising player.
Figure 6C:
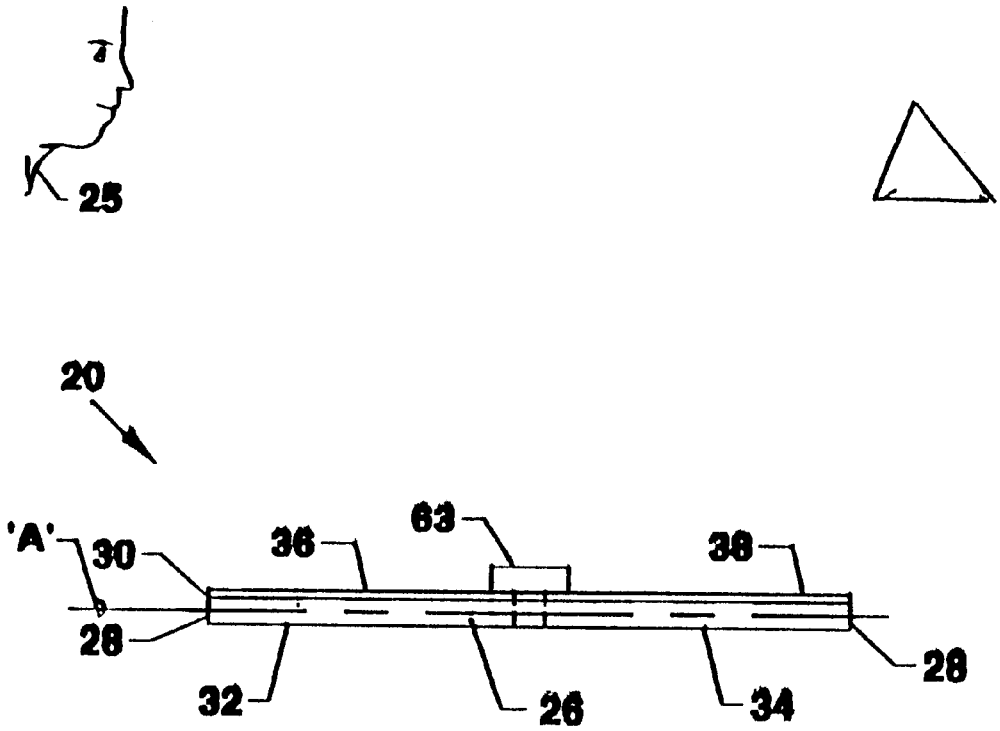

Accordingly, the present invention also provides a method of teaching hockey skills comprising the following steps. A practice surface, namely the top surface 38, for receiving a hockey puck 24 thereon is provided, and is preferably disposed on a hockey practice apparatus 20. The visual target 70 having instructional indicia thereon is initially placed adjacent the practice surface, as can be best seen in FIG. 6A, so as to be viewable concurrently with the practice surface by a practising player 25 standing beside the practice surface and stickhandling the puck 24 with a hockey stick 22, thereby encouraging the practising player 25 to look at the visual target 70 while stickhandling the puck 24 with a hockey stick 22. After practising for a considerable period of time, the practising player 25 becomes skilled at stickhandling while looking at the visual target 70 in a given position. As can be seen in FIG. 6B, the visual target 70 is subsequently moved to a superior position in the practising player's field of view, or in other words a position that encourages the player 25 to keep his head oriented up even more than before, thereby encouraging the practising player 25 to look up while stickhandling the puck 24 with a hockey stick 22. The step of moving the visual target 70 is repeated a few times so as to move the visual target 70 further and further away from the practice apparatus 20, as indicated by indeterminate length arrow "C" in FIG. 6B. The step of moving the visual target 70 is repeated until the visual target 70 is at the eye level of the practising player 25 stickhandling the puck 24 with a hockey stick 22, as can be seen in FIG. 6C.

Figure 5A:
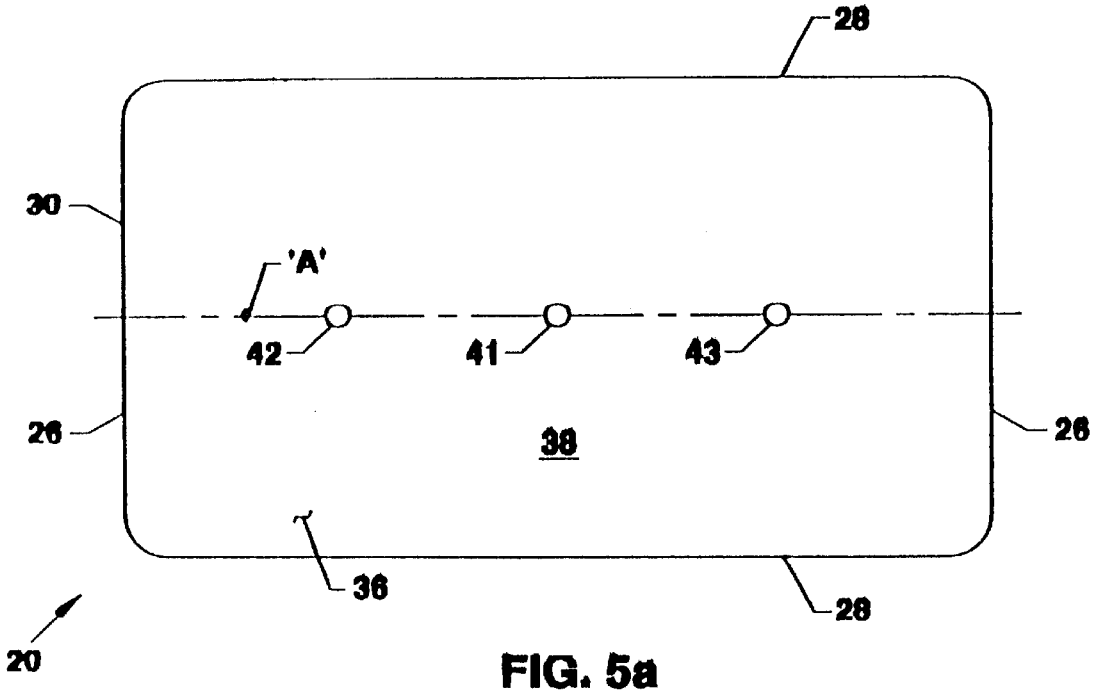
FIG. 5A is a top plan view similar to FIG. 2, with no obstacles in place on the hockey practice apparatus.

The first obstacle 61, the second obstacle 62, and the third obstacle 63 are each selectively situateable on and removable from the thin mat member 30, as aforesaid, in at least one designated obstacle receiving position, and in the preferred embodiment, in a plurality of designated obstacle receiving positions, namely in the first orifice 41, the second orifice 42, and the third orifice 43. Initially, none of the obstacles is placed on the hockey practice apparatus 20, as can be seen in FIG. 5A. The practising player 25 is encouraged to keep his head up by the phrase "HEADS UP" on the visual target 70 and will develop his own basic natural stickhandling pattern, while learning to keep his head up.

Figure 5B:
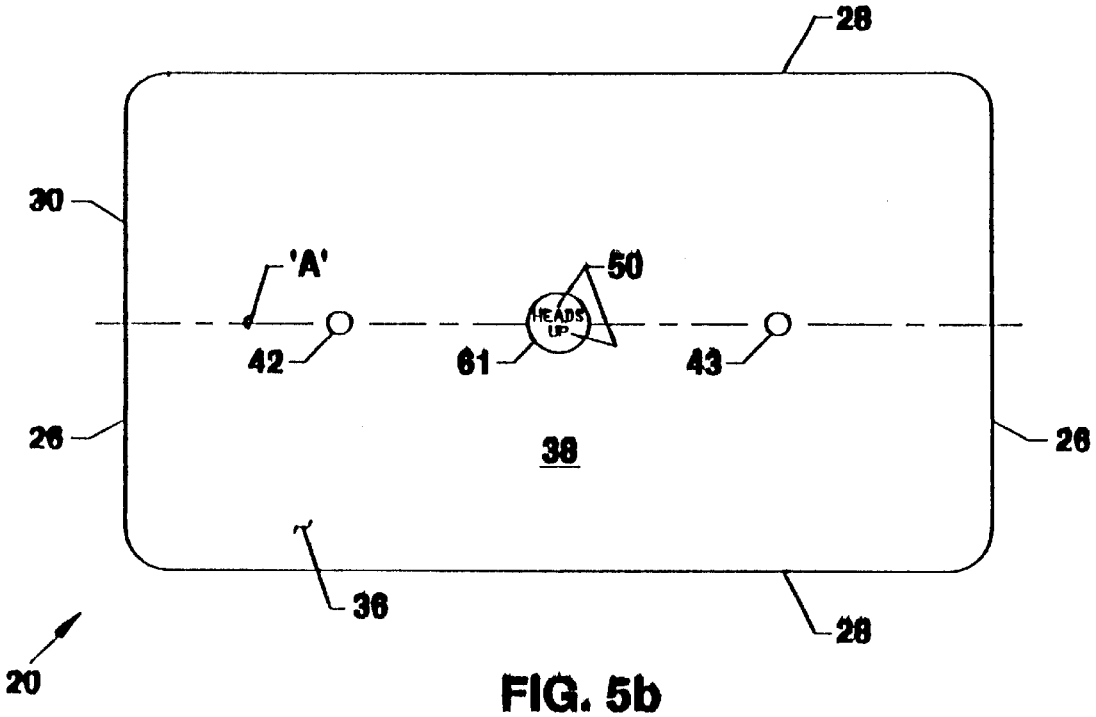
FIG. 5B is a top plan view similar to FIG. 5A, with a first obstacle in place on the hockey practice apparatus in a centrally positioned orifice.

Next, it is preferable to place only the first obstacle 61 in the central first orifice 41, as can be seen in FIG. 5B, so as to provide a single circumventable obstruction to the passage of the hockey stick 22 and puck 24 along the top surface 38 of the thin mat member 30. The practising player 25, who is encouraged to keep his head up by the phrase "HEADS UP" on the first obstacle 61, will develop his own natural stickhandling pattern around the first obstacle 61.

Figure 5C:
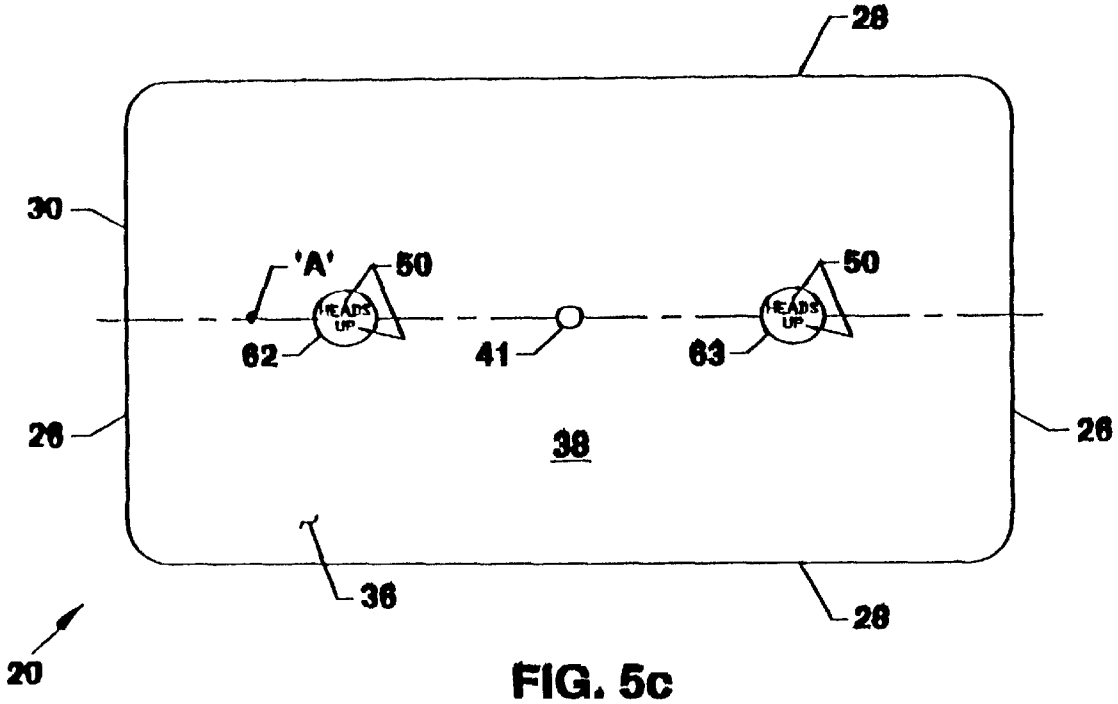
FIG. 5C is a top plan view similar to FIG. 5B, with a first obstacle and a second obstacle each in place on the hockey practice apparatus in a respective non-centrally positioned orifice.

Once the player 25 feels competent stickhandling around the first obstacle 61, the next step is to remove the first obstacle 61 from the central first orifice 41, add the second obstacle 62 to the second orifice 42, and to add the third obstacle 63 to the third orifice 43, as can be seen in FIG. 5C. Alternatively, and essentially analogously, since the first 61, second 62, and third 63 obstacles are all the same, the first obstacle 61 may be simply moved to the third orifice 43. The practising player 25, who is encouraged to keep his head up by the phrase "HEADS UP" on the first 61 and second 62 obstacles, will develop his own more complicated natural stickhandling pattern around the first 61 and second 62 obstacles.

Figure 5D:
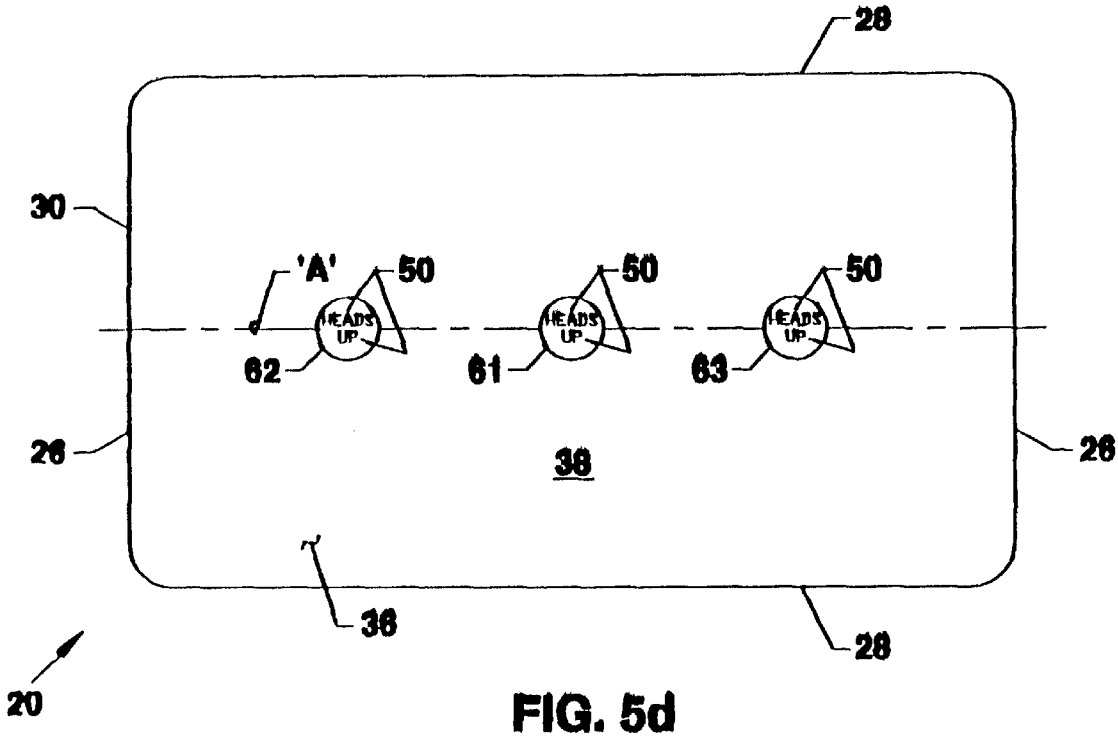
FIG. 5D is a top plan view similar to FIG. 5C, with a first obstacle, a second obstacle, and a third obstacle, each in place on the hockey practice apparatus in a respective orifice.

Finally, the first obstacle 61, the second obstacle 62, and the third obstacle 63 are all inserted into the first orifice 41, the second orifice 42, and the third orifice 43, respectively, as can be seen in Fig. 5D. The practising player 25, who is encouraged to keep his head up by the phrase "HEADS UP" on the first 61, second 62, and third 63 obstacles, will eventually develop a series of skilful yet natural stickhandling patterns around the first 61, second 62, and third 63 obstacles.

Other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims.

We claim:

1. Apparatus for teaching a hockey player to keep his head up while stickhandling a hockey puck with his hockey stick, said apparatus comprising a thin mat member having a length and a width each substantially greater than its thickness, a generally centrally disposed longitudinal axis extending along its length, and including a bottom stratum presenting a slippage precluding bottom surface and a top stratum adjoined to said bottom stratum and presenting a low friction substantially planar top surface for receiving a hockey puck in free sliding relation thereon, said apparatus further comprising a first obstacle situateable adjacent said thin mat member so as to extend upwardly from said top surface of said thin mat member, thereby providing a first circumventable obstruction to the passage of said player's hockey stick and said hockey puck along said top surface of said thin mat member.

2. The apparatus of claim 1, wherein said first obstacle is selectively situateable on and removable from said thin mat member.

3. The apparatus of claim 2, further comprising at least one designated obstacle receiving position, and wherein said first obstacle is selectively situateable on and removable from said thin mat member, as aforesaid, in said at least one designated obstacle receiving position.

4. The apparatus of claim 3, further comprising a plurality of designated obstacle receiving positions, and wherein said first obstacle is selectively situateable on and removable from said thin mat member, as aforesaid, at said plurality of designated obstacle receiving positions.

5. The apparatus of claim 4, further comprising a plurality of orifices in said thin mat member, each orifice being disposed at a corresponding designated obstacle receiving position, to receive a portion of said first obstacle therein.

6. The apparatus of claim 5, further comprising a second obstacle situateable adjacent said thin mat member so as to extend upwardly from said top surface of said thin mat member, thereby providing a second circumventable obstruction to the passage of said player's hockey stick and said hockey puck along said top surface of said thin mat member.

7. The apparatus of claim 6, further comprising a third obstacle situateable adjacent said thin mat member so as to extend upwardly from said top surface of said thin mat member, thereby providing a third circumventable obstruction to the passage of said hockey stick and said hockey puck along said top surface of said thin mat member.

8. The apparatus of claim 7, wherein said first, second and third obstacles are each received in frictional fit relation in a corresponding orifice.

9. The apparatus of claim 8, wherein said first, second and third obstacles are interchangeable one with another in said orifices.

10. The apparatus of claim 9, wherein said orifices extend completely through said thin mat member.

11. The apparatus of claim 10, wherein said orifices are aligned along said generally centrally disposed longitudinal axis, so as to provide the same amount of room for stickhandling between the first, second and third obstacles, and each of the side edges of the thin mat member.

12. The apparatus of claim 11, wherein said first, second and third obstacles each have a main body portion and a post portion having a smaller diameter than said main body portion, and wherein said post portions are each received in frictional fit relation in a corresponding orifice.

13. The apparatus of claim 11, wherein said mat member has a substantially constant thickness.

14. The apparatus of claim 13, wherein said top stratum is made from polycarbonate resin material.

15. The apparatus of claim 14, wherein said top stratum is less than about ⅜" thick.

16. The apparatus of claim 15, wherein said bottom stratum is resiliently deformable.

17. The apparatus of claim 16, wherein said bottom stratum is made from polymer foam material.

18. The apparatus of claim 17, wherein said top stratum is about 1/16" thick.

19. The apparatus of claim 1, further comprising instructional indicia disposed on said first obstacle.

20. The apparatus of claim 1, further comprising a visual target having Instructional Indicia, which visual target is for placement in a series of positions adjacent said hockey practice apparatus.

* * * * *